US005894797A

United States Patent [19]

Brennan et al.

[11] Patent Number: 5,894,797

[45] Date of Patent: Apr. 20, 1999

[54] TENSION CONTROL DEVICE FOR A PRINTING PRESS

[75] Inventors: Kenneth R. Brennan, Westmont; Theodore Costopoulos, Lisle; Frederick J. Whiting, LaGrange, all of Ill.

[73] Assignee: Goss Graphic Systems, Inc., Westmont, Ill.

[21] Appl. No.: 08/908,008

[22] Filed: Aug. 11, 1997

Related U.S. Application Data

[63] Continuation of application No. 08/734,552, Oct. 17, 1996, abandoned, which is a continuation of application No. 08/521,157, Aug. 30, 1995, abandoned.

[51] Int. Cl.[6] ..... B41F 13/56

[52] U.S. Cl. ..... 101/226; 226/42; 226/195

[58] Field of Search ..... 101/219, 225, 101/226, 227, 232; 226/3, 29, 38, 40, 42, 44, 45, 195

[56] References Cited

U.S. PATENT DOCUMENTS

| | | | |
|---|---|---|---|
| 3,556,510 | 1/1971 | Treff | 101/226 |
| 3,912,145 | 10/1975 | Meihofer | 101/226 |
| 4,065,067 | 12/1977 | Martinez | 242/58.1 |
| 4,147,104 | 4/1979 | Zernov et al. | 101/228 |
| 4,253,597 | 3/1981 | Waffner | 226/40 |
| 4,341,335 | 7/1982 | Schmid | 226/195 |
| 4,566,353 | 1/1986 | Stiff | 101/226 |
| 4,569,285 | 2/1986 | Forno et al. | 101/232 |
| 4,657,164 | 4/1987 | Felix | 226/42 |
| 4,896,808 | 1/1990 | Bolza-Schünemann et al. | 226/42 |
| 4,955,265 | 9/1990 | Nakagawa et al. | 226/28 |
| 5,050,812 | 9/1991 | Mueller | 226/36 |
| 5,419,509 | 5/1995 | Krayenhagen | 242/419 |
| 5,438,926 | 8/1995 | Hudyma et al. | 101/227 |

FOREIGN PATENT DOCUMENTS

| | | |
|---|---|---|
| 649 927 A2 | 4/1995 | European Pat. Off. . |
| 1 597 315 | 6/1970 | France . |
| 1 250 228 | 9/1967 | Germany . |
| 26 44 298 | 7/1977 | Germany . |
| 94 06 068 | 6/1994 | Germany . |
| 63 278880 | 11/1988 | Japan . |
| 21 63255 | 6/1990 | Japan . |
| 605 367 | 9/1978 | Switzerland . |
| 410 859 | 6/1934 | United Kingdom . |
| WO 95/11183 | 4/1995 | WIPO . |

OTHER PUBLICATIONS

Herbert L. Weiss, "Control System for Web–Fed Machinery," Guide to the Design, Selection & Usage of Hydraulic, Pneumatic and Electronics Control Systems for Web Fed Machinery, pp. 295–300, 1983.

*Primary Examiner*—Eugene Eickholt

[57] ABSTRACT

A tension control device (50) for a printing press (10) having an adjustment roller (52), a device (64 and 66) for measuring the tension on opposed sides of a web (14) passing downstream from the adjustment roller (52), and a device (82) responsive to the measuring device (64 and 66) for automatically approximately equalizing the tension of the web (14) on the adjustment roller (52) on opposed sides of the adjustment roller (52).

5 Claims, 4 Drawing Sheets

TENSION CONTROL DEVICE FOR A PRINTING PRESS

This is a continuation of application Ser. No. 08/734,552 filed Oct. 17, 1996 and now abandoned which in turn is a continuation of Ser. No. 08/521,157, filed Aug. 30, 1995 now abandoned.

BACKGROUND OF THE INVENTION

The present invention relates to tension control devices for a printing press.

Before the present invention, multi-color printing units have been used in a printing press to print colored images on a paper web. The webs used in the press unwind the web from a supply roll. Due to the relatively fast speed of the press, the rolls have been completely unwound in a relatively short period of time, such as 15 minutes.

In accordance with prior practice, a new roll of the web is pasted onto the web of the previous roll when it is almost depleted. However, the rolls each have different characteristics, such as different manufacture and different winding tensions. As a result, the tension on opposed sides of the new web becomes significantly different, causing loss of registration in the press, and flapping of the web which may cause a web break.

Adjustments must be made to the press in the event of loss of registration, and due to the relative frequency of web pasting This factor results in loss of press time, wasted product, and inconvenience to the operator of the press.

SUMMARY OF THE INVENTION

The present invention relates to an improved tension control device for a printing press.

The device of the present invention comprises an adjustment roller, and means for measuring the tension on opposed sides of a web passing downstream from the adjustment roller.

A feature of the invention is the provision of means responsive to the measuring means for automatically approximately equalizing the tension of the web on the adjustment roller on opposed sides of the adjustment roller.

Thus, a feature of the invention is that the device minimizes the loss of registration otherwise due to a web paste.

Another feature of the invention is that the device minimizes flapping of the web otherwise caused by the web paste.

A further feature of the invention is that adjustment to tension of the adjustment roller are made to only one side of the adjustment roller.

Thus, a feature of the invention is that the device is of simplified construction and reduced cost.

A feature of the invention is that the device minimizes the amount of waste and time in operating the press otherwise due to the web paste.

Further features will become more fully apparent in the following description of the embodiments of the invention and from the appended claims.

DESCRIPTION OF THE PREFERRED EMBODIMENTS

Figure 1:
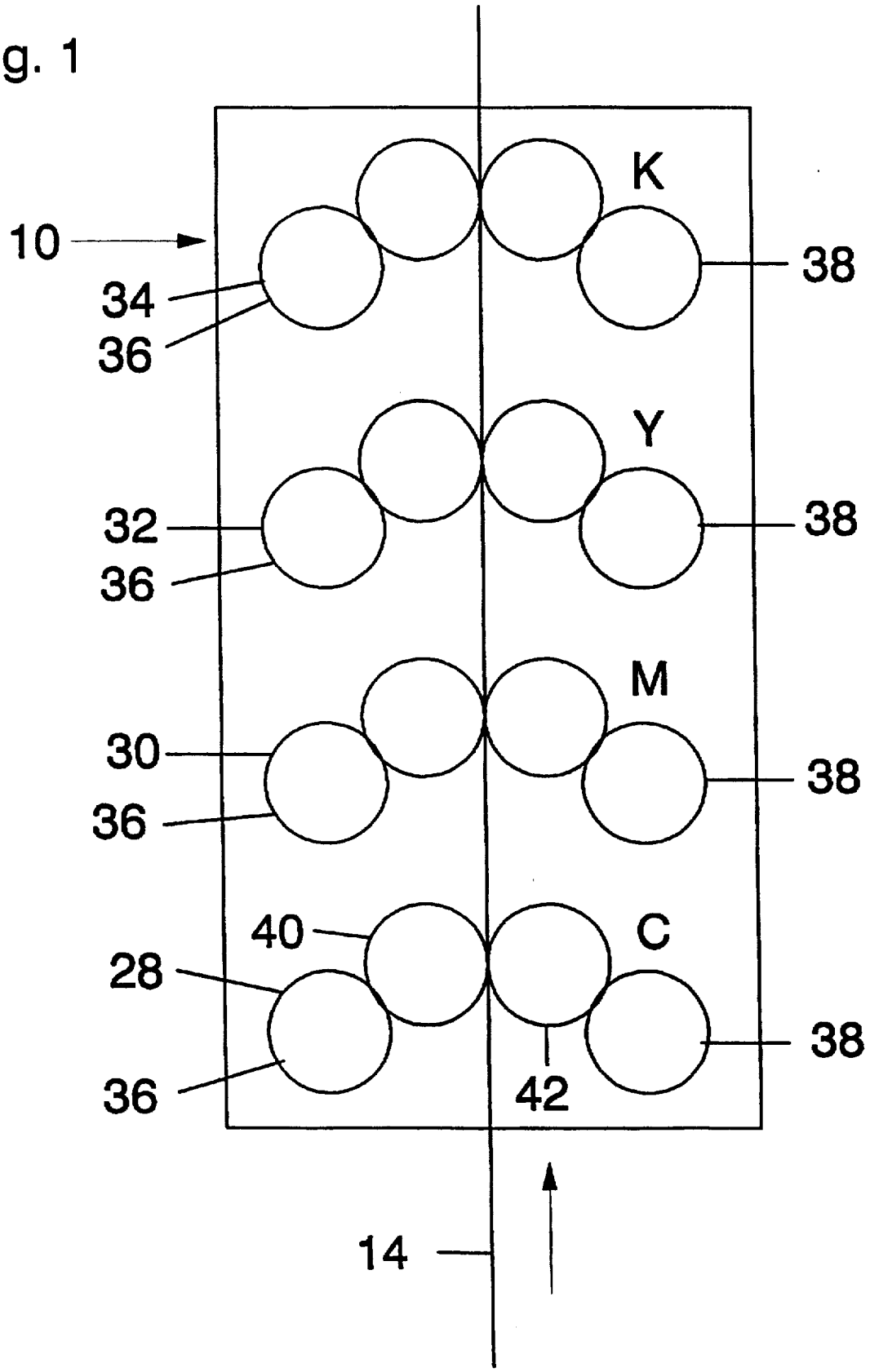
FIG. 1 is a diagrammatic view of a printing press for use of a tension control device of the present invention.

Referring now to FIG. 1, there is shown a printing press generally designated 10 for printing an image on a paper web 14. The press 10 has a plurality of printing units 28, 30, 32, and 34 for printing different colors of ink on the web 10. As shown, the printing unit 28 may print an ink having a color Cyan C, the printing unit 30 may print an ink having a color Magenta M, the printing unit 32 may print an ink having the color Yellow Y, and the printing unit 34 may print an ink having a color black K in a four-color press 10.

The printing units 28, 30, 32, and 34 each have a plurality of print rolls or cylinders 36 associated with a blanket cylinder or roll 40. During printing by the press 10, an image of the ink is transferred from the print rolls 36 to the associated blanket rolls 40 to print the image on one surface of the web 14. In addition the press 10 may have a plurality of printing units having a plurality of print rolls 38 associated with a plurality of blanket rolls or cylinders 42 on an opposed side of the web 14 in order to transfer the ink image from the print rolls 38 to the blanket rolls 42 for printing an image on the other surface of the web 14. The following description of the print rolls is equally applicable to either the print rolls 36 or the print rolls 38 on the opposed sides of the web 14.

Figure 2:
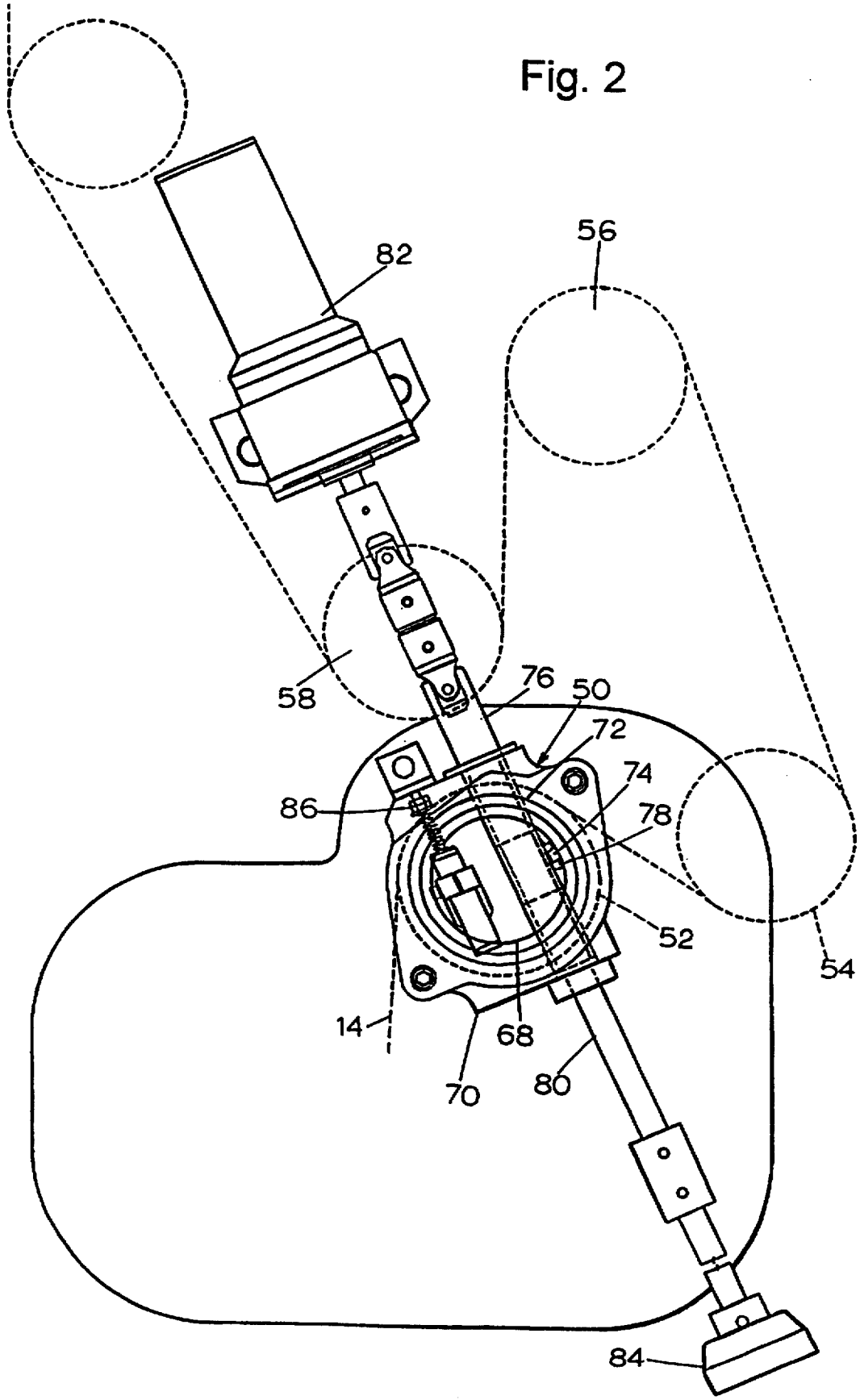
FIG. 2 is an elevational view of the tension control device.

With reference to FIG. 2, the press 10 has a device 50 for controlling tension of the web 14 of the press 10. As shown, the web 14 passes from a supply roll around an adjustment roller 52 to a tension roller 54. The web 14 passes from the tension roller 54 around a dancer roller 56 to an idler roller 58 and then to the printing units of the press 10.

Figure 4:
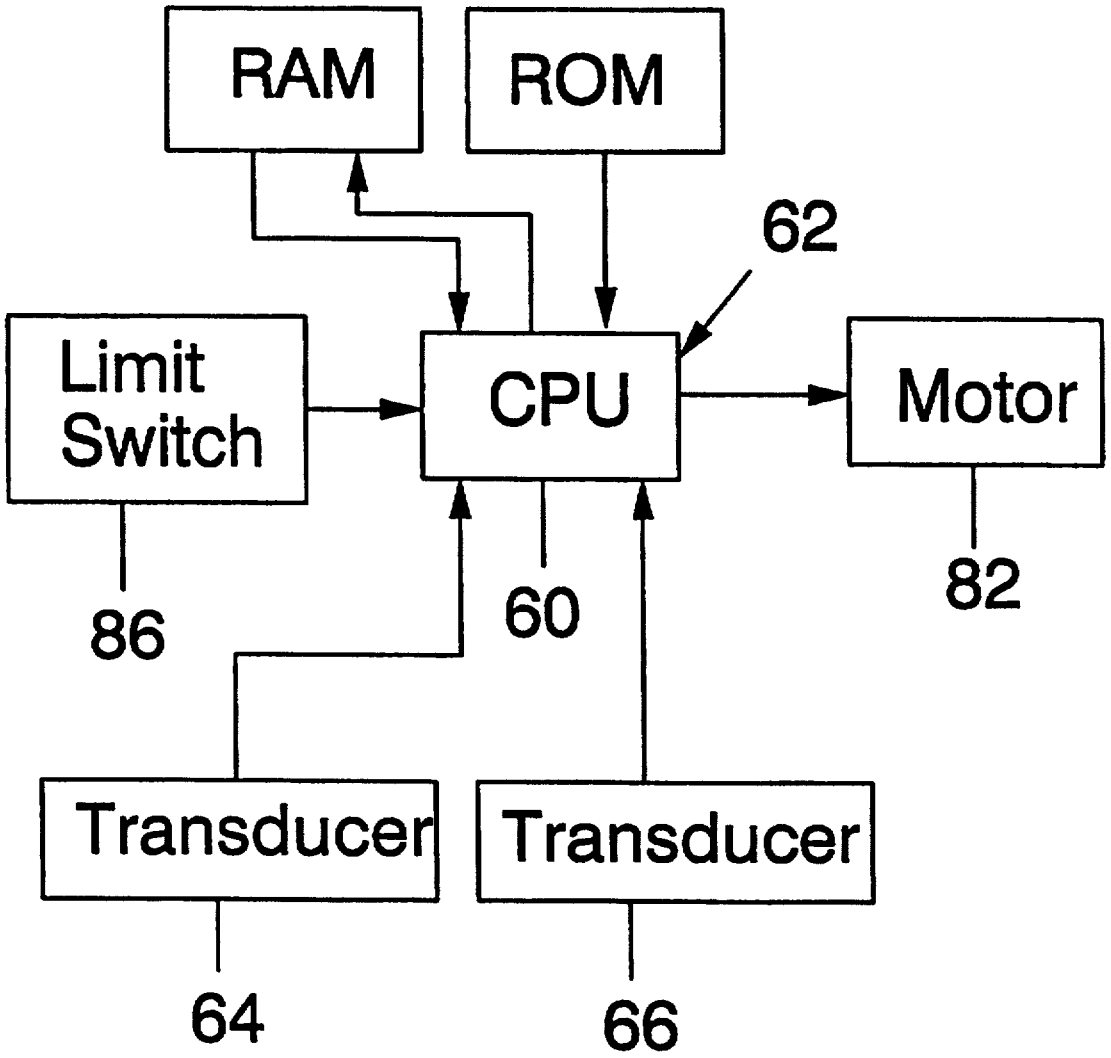
FIG. 4 is a block diagram of a control system of the tension control device of FIG. 20.

With reference to FIG. 4, the press 10 has a control system 62 having a computer 60 or Central Processing Unit (CPU) having a Random Access Memory (RAM) and Read Only Memory (ROM). As will be seen below, the control system 62 controls operation of the device 50, as shown in FIG. 2.

Figure 3:
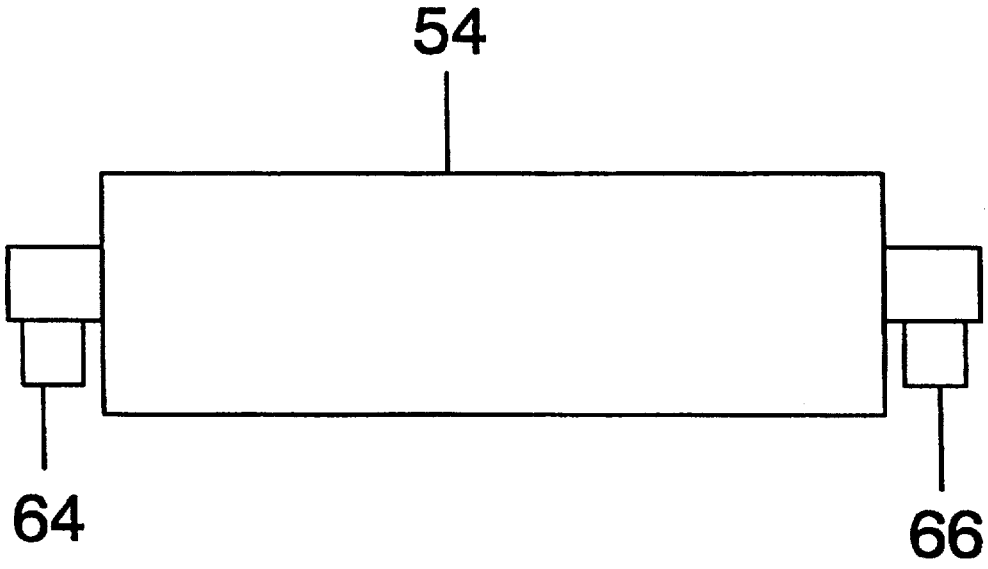
FIG. 3 is a diagrammatic view of a tension roller for the device of FIG. 2.

As shown in FIGS. 2 and 3, the tension roller 54 has transducers 64 and 66 on opposed sides of the tension roller 54. The transducers 64 and 66 are of known type, and measure the tension caused by the web 14 on opposed ends of the tension roller 54.

With reference to FIG. 2, the adjustment roller 52 has a bearing cup 68 on one side only of the adjustment roller 52, along with a bearing housing 70 for the cup 68. The bearing housing 70 has a bore 72 having inwardly directed helical teeth 74. The device 50 has an elongated shaft 76 having outwardly directed helical teeth 78 which mesh with the teeth 74. The device 50 has an elongated shaft 80 having the teeth 78 in the region of the bearing housing 70, while the housing 70 has the teeth 74 which meshes with the teeth 78 of the shaft 80. Thus, rotation of the shaft 80 causes a displacement of the bearing cup 68 and the one end of the adjustment roller 52 which has the bearing cup 68. In this manner, the tension of the web 14 on the one end of the adjustment roller 52 may be adjusted, which takes place automatically since the shaft 80 is rotated by a two-speed motor 82 attached to the shaft 80. The device 50 also has an elongated hand wheel 84 attached to an opposed end of the shaft 80 relative to the motor 82 in order to make manual adjustments to the shaft 80, with the automatic system off, if desired.

The device 50 operates to sense a difference in tension on the transducers 64 and 66 on opposed ends of the tension roller 54. It is desired to obtain an identical tension on the opposed ends of the tension roller 54 in order to compensate for the paste of the web 14 from a depleted roll of web 14 to a new roll of the web 14. The condition of pasting a new roll of web 14 usually causes the device 50 to determine a different tension on the transducers 64 and 66.

In the event of the differing tension of the transducers 64 and 66, the device 50 actuates the motor 82 to rotate the shaft 80 and cause displacement of the bearing cup 68 and the one end of the adjustment roller 52. The motor 82 operates on the shaft 80 in a direction which will minimize the difference in tension on the transducers 64 and 66 of the tension roller 54. In this manner, the press 10 compensates for the web paste, and minimizes the occurrence of the loss of registration and flapping of the web 14 due to the web paste.

In this manner, the device 50 minimizes the loss of registration due to a web paste resulting in reduced waste of the printed web 14 and inconvenience to the operating personnel due to the frequent web pastes.

AS shown in FIG. 2, the device 50 also has a limit switch 86 which signals the computer 60 in the event that a predetermined limit on adjustment of the adjustment roller 52 takes place, in which case the motor 82 is deactivated.

The transducers 64 and 66 can measure when the web 14 is initially pasted due to relatively high fluctuation of the tension on opposed ends of the tension roller 54. In this case, the motor 82 runs at a first fast speed in order to make coarse corrections to the one end of the adjustment roller 52 as controlled by the CPU. Once the coarse corrections have been made by the motor 82, the CPU causes the motor 82 to move at a second slow rate in order to make fine adjustments to the one end of the adjustment roller 52. In this manner, the one end of the adjustment roller may be adjusted in a rapid and accurate manner.

Fine adjustments are made as the expiring roll decreases to adjust for small variations in tension.

The foregoing detailed description has been given for clearness of understanding only, and no unnecessary limitations should be understood therefrom, as modifications will be obvious to those skilled in the art.

What is claimed is:

1. A tension control device for a printing press, comprising an adjustment roller, with a web of the press passing directly from a supply roll of the web to the adjustment roller;

means for measuring the tension on opposed sides of the web passing downstream from the adjustment roller;

means responsive to the measuring means for automatically approximately equalizing the tension of the web on the adjustment roller on opposed sides of the adjustment roller by adjustment of the roller on one side only of the roller.

2. The device of claim 1 wherein the equalizing means comprises means for adjusting one side only of the adjustment roller.

3. The device of claim 1 wherein the equalizing means comprises a motor.

4. The device of claim 3 wherein the motor has a plurality of speeds to modify the rate of adjustment of the adjustment roller.

5. The device of claim 1 including a limit switch to control excessive adjustments of the adjustment roller.

* * * * *